US006102155A

United States Patent [19]

Hood et al.

[11] Patent Number: 6,102,155

[45] Date of Patent: Aug. 15, 2000

[54] COMBINED WINDOW AND EMERGENCY ESCAPE LADDER

[76] Inventors: Joshua H. Hood; Sandra Jo Hood; Robert P. Hood, all of 818 Kingswood Ave., Richardson, Tex. 75080

[21] Appl. No.: 09/172,925

[22] Filed: Oct. 14, 1998

[51] Int. Cl.[7] ..... A62B 1/20

[52] U.S. Cl. ..... 182/76; 182/70; 182/198

[58] Field of Search ..... 182/70, 76, 198, 182/196, 197

[56] References Cited

U.S. PATENT DOCUMENTS

| | | | |
|---|---|---|---|
| 116,659 | 7/1871 | Alz | 182/76 |
| 433,061 | 7/1890 | Aarons | 182/76 |
| 453,951 | 6/1891 | White | 182/76 |
| 589,569 | 9/1897 | Muller | 182/76 |
| 639,902 | 12/1899 | Mace | 182/76 |
| 1,397,643 | 11/1921 | Lyle | 182/76 |
| 3,670,846 | 6/1972 | Jones | 182/76 |
| 3,946,834 | 3/1976 | Shafer et al. | 182/164 |
| 5,467,841 | 11/1995 | Krumal | 182/198 |
| 5,499,692 | 3/1996 | Brook | 182/196 |
| 5,605,205 | 2/1997 | Douglas et al. | 182/198 |

*Primary Examiner*—Alvin Chin-Shue
*Attorney, Agent, or Firm*—Baker & Botts, L.L.P.

[57] ABSTRACT

An emergency escape system (16) for a window (13) of a building (10) includes an escape ladder (36) stored within a window frame (21). A sill part (23) covers a recess (32) containing the escape ladder and allows a window part (22) to form a normal seal with the sill as if no escape ladder system were present. In an emergency, the escape ladder can be quickly deployed to allow a person to exit the building safely through the window. Spacers (88) can be used to provide a more stable escape ladder. A removable cartridge (81) can also be used to easily replace the escape ladder system after the escape ladder has been used or damaged.

8 Claims, 2 Drawing Sheets

FIG. 1
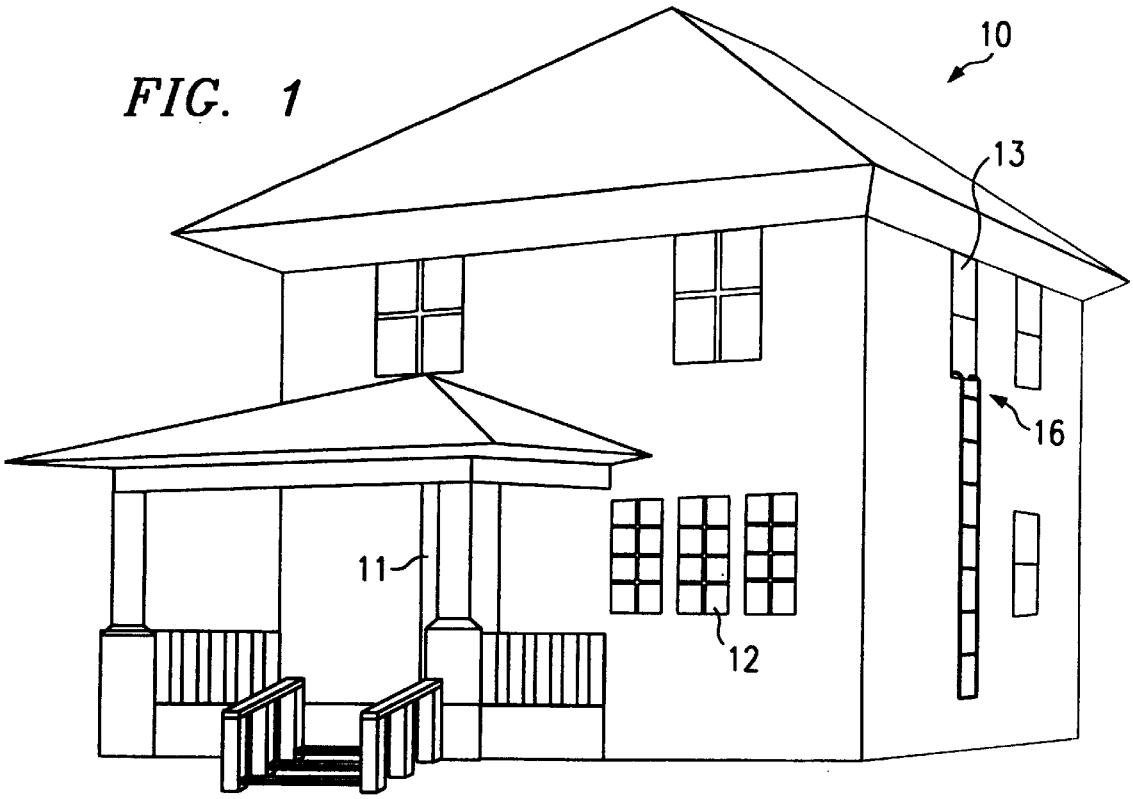
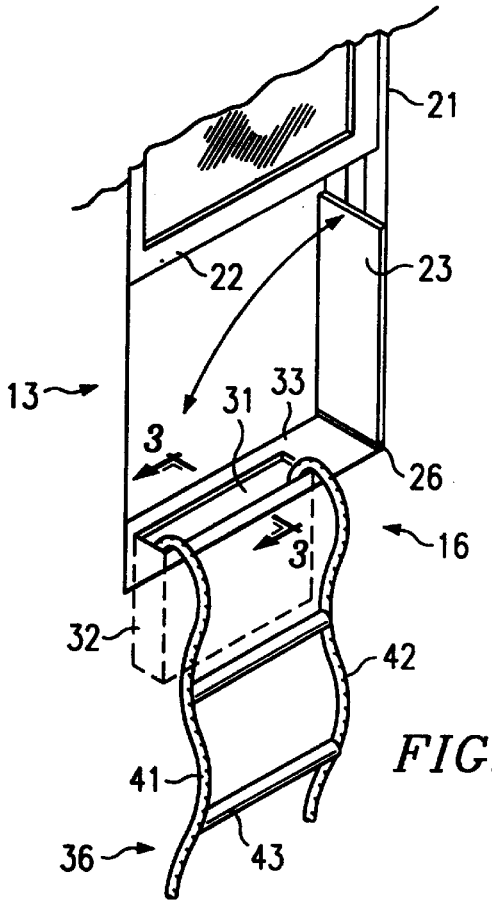
FIG. 2

COMBINED WINDOW AND EMERGENCY ESCAPE LADDER

TECHNICAL FIELD OF THE INVENTION

This invention relates in general to arrangements for emergency escape from a building and, more particularly, to such an arrangement which includes a window apparatus having a collapsible escape ladder.

BACKGROUND OF THE INVENTION

Multi-story structures are common today. When an emergency occurs in a multi-story structure, the people on the second, third or higher floors may find it difficult to reach the normal exits. When normal exits are unavailable, alternate emergency exits must be found. One such alternate emergency exit is a window. However, exiting through a window two or more stories above the ground may be dangerous.

A ladder may be used to exit from second story or higher windows, but storing a noncollapsible ladder by every window is impractical. Thus, foldable escape ladders were developed to avoid the storage problem. One example is the combination window and escape ladder disclosed in U.S. Pat. No. 5,467,841. While these known systems have been generally adequate for their intended purpose, they have not been entirely satisfactory in all respects. For example, the structural features of the window specific to the emergency escape feature are often complex and expensive, and may interfere with the extent to which the window can be used in a normal manner when there is no emergency. Accordingly, it is an object of this invention to provide a foldable escape ladder that can be located easily and quickly in an emergency, that does not interfere with normal use of an associated window, and that is relatively simple and inexpensive.

SUMMARY OF THE INVENTION

From the foregoing, it may be appreciated that a need has arisen for an apparatus for facilitating emergency exit from multi-story structures, which is integrated into a window in a manner which minimizes interference with normal use of the window, which is easy to locate and deploy, and which is relatively simple and inexpensive.

According to the present invention, an apparatus is provided to address this need, which includes a window frame, the window frame including a lower portion which has thereon an upwardly facing surface and which has therein a recess that opens upwardly through a vertical opening provided in the upwardly facing surface, the window frame further including a sill part movable relative to the lower portion between a first position obstructing the opening and a second position remote from the opening. The apparatus further includes a window part supported in the frame for movement relative thereto between open and closed positions, the window part being movable independently of the sill part, and the window part being in sealing engagement with the sill part when the window part is in the closed position and the sill part is in the first position. Also included in the apparatus is an escape ladder which includes flexible first and second elongate elements each having first and second ends, and which includes a plurality of rung elements extending between the elongate elements at spaced locations therealong, wherein the ladder can be removably received within the recess. The apparatus also includes an arrangement for retentively coupling the first end of each elongate element to the window frame.

BRIEF DESCRIPTION OF THE DRAWINGS

A better understanding of the present invention will be realized from the detailed description which follows, taken in conjunction with the accompanying drawings, in which:

FIG. 1 is a diagrammatic perspective view of a two-story structure which has a window escape ladder system embodying the present invention;

FIG. 2 is a diagrammatic perspective view of the window escape ladder system of FIG. 1;

DETAILED DESCRIPTION OF THE INVENTION

Figure 3:
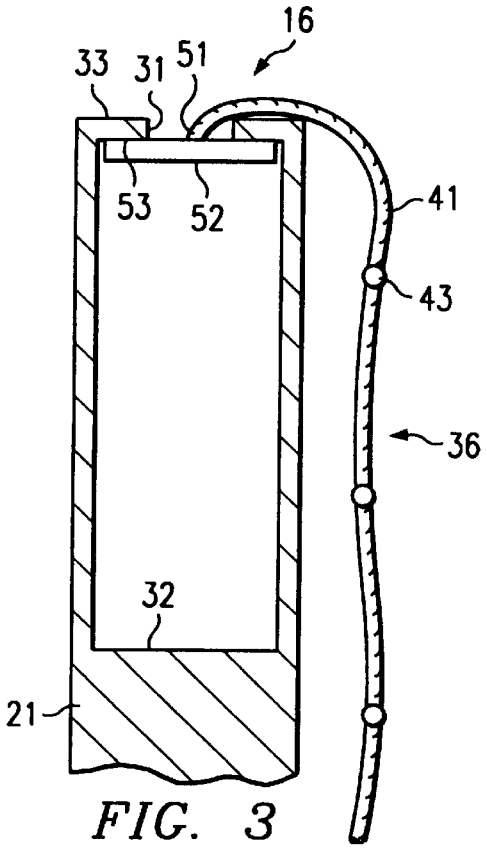
FIG. 3 is a sectional side view of part of a window frame and a deployed escape ladder which are components of the window escape ladder system of FIG. 2.

FIG. 1 is a diagrammatic perspective view of a two-story structure 10, which in the disclosed embodiment is a house. The structure 10 includes a door 11, a plurality of first story windows 12 and a plurality of second story windows 13. One of the second story windows 13 is equipped with an escape ladder system 16, which is more fully described in association with FIG. 2. The escape ladder system 16 allows a person to safely descend from the second story window 13 to the ground outside of the house, for example in the event of an emergency such as a fire.

FIG. 2 is a diagrammatic perspective view of the window 13 equipped with the escape ladder system 16. The window 13 includes a window frame 21, within which is movably supported a window part 22. The window part 22 can move in a generally vertical manner within the window frame 21 between an open position and a closed position. FIG. 2 shows the window part 22 in the open position. A sill part 23 is pivotally supported at one end within the window frame 21. The sill part 23 is pivotally coupled to the window frame 21 via a hinge 26. The sill part 23 moves by pivoting on the hinge 26 between an open position and a closed position. FIG. 2 shows the sill part 23 in the open position. The window part 22 and the sill part 23 can move independently of each other. The sill part 23 can only be opened when the window part 22 is in the open position. Similarly, the window part 22 can be closed only when the sill part 23 is in the closed position.

Also provided within the window frame 21 is an opening 31 that opens downwardly into a recess 32 provided in the window frame 21, the opening 31 being of a rectangular shape and being provided through an upwardly facing surface 33 on the window frame 21. Extending out of the recess 32 through the opening 31 is an escape ladder 36. The opening 31, recess 32 and escape ladder 36 are more fully described in association with FIG. 3.

A clearer understanding of the escape ladder system 16 is achieved by considering the perspective view of the escape ladder system 16 of FIG. 2 in association with the sectional view of the recess 32 and escape ladder 36 shown in FIG. 3. As shown in FIG. 2, the escape ladder 36 includes a first elongate element 41 and a second elongate element 42. The elongate elements 41 and 42 are flexible and are made of a weight-bearing material such as rope or chain. The elongate elements 41 and 42 support one or more rungs 43. Each rung 43 has a first and second rung end which are respectively fixedly coupled to the first and second elongate elements 41 and 42. Rungs 43 are typically attached to the elongate elements 41 and 42 in such a way that the rungs 43 are regularly spaced therealong with respect to each other. As shown in FIG. 3, each of the elongate elements 41 and 42 has a first end, one of which is indicated by reference number 51. The first ends 51 are coupled to a retaining element 52. The retaining element 52 is a rectangular element of dimensions greater than those of the opening 31. The retaining element 52 can move in a generally vertical manner within the recess 32, but cannot exit through the opening 31 because the retaining element 52 is greater in size than the opening 31. FIG. 3 shows the retaining element 52 at the element's highest vertical travel point. When the retaining element 52 is at the element's highest vertical travel point, the retaining element 52 is engaged with a downwardly facing surface 53. When the retaining element 52 is engaged with the downwardly facing surface 53, the retaining element 52 is prevented from moving further in an upward direction.

Figure 4:
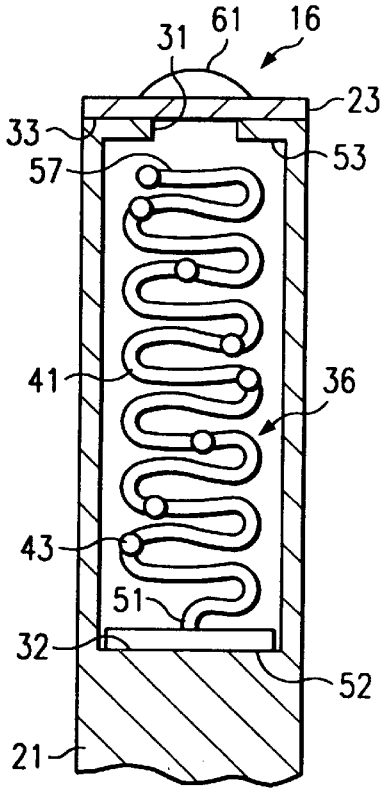
FIG. 4 is a sectional side view similar to FIG. 3, but with the escape ladder in a stored condition.

FIG. 4 is a sectional side view of the window frame 21 showing the escape ladder 36 stored in the recess 32. When the escape ladder 36 is stored in the recess 32, the elongate elements 41 and 42 and the rungs 43 are preferably arranged in a serpentine manner which facilitates removal of the escape ladder 36 from the recess 32. The retaining element 52 is shown in FIG. 4 in its stored position at the bottom of the recess 32. The elongate elements 41 and 42 each have a second end 57, and FIG. 4 shows the second end 57 of the first elongate element 41. The second end 57 is also shown in its stored position in the recess 32. The second end 57 is coupled to the last or bottom rung 43 which is a part of the escape ladder 36. FIG. 4 further shows the sill part 23 in the closed position. Secured to the upward facing surface of the sill part 23 is a seal element 61, which extends the full length of the sill part 23.

Figure 5:
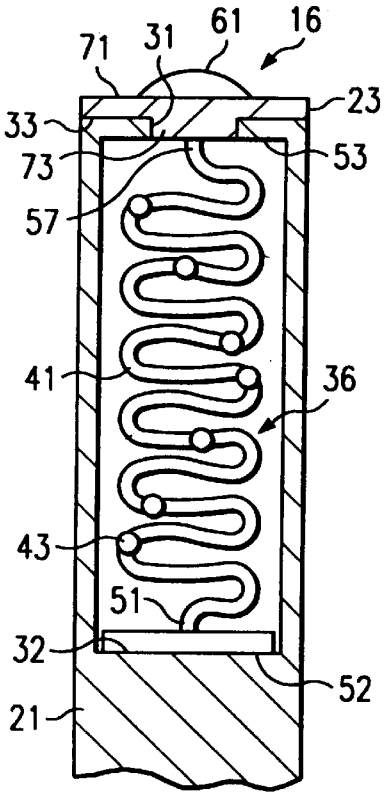
FIG. 5 is a sectional side view similar to FIG. 3, but showing an alternative embodiment of the window frame and escape ladder.

An alternate embodiment of the present invention is shown in FIG. 5, which is a sectional side view of the window frame 21. In this embodiment, the hinged sill part 23 is replaced with a sill part 71. The sill part 71 is not coupled to any part of the window frame 21. The sill part 71 includes a downward projection 73. The projection 73 has dimensions slightly less than those of the opening 31 so that the projection 73 can approximately fill the opening 31. The projection 73 approximately fills the opening in order to substantially prevent horizontal movement of the sill part 71 relative to the window frame 21. The projection 73 of the sill part 71 is coupled to the second ends 57 of the first and second elongate elements 41 and 42. Thus, in this embodiment, the sill part 71 also serves as the bottom rung 43 of the escape ladder 36.

Figure 6:
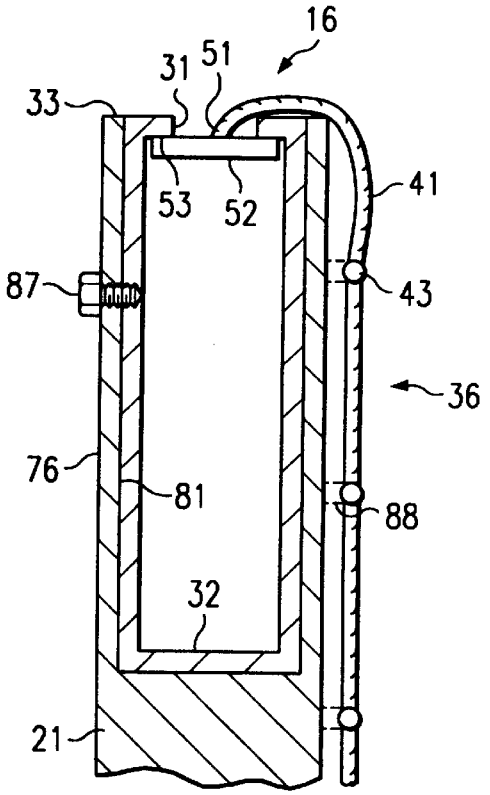
FIG. 6 is a sectional side view similar to FIG. 3, but showing a further alternative embodiment of the window frame and escape ladder.

Another alternative embodiment of the present invention is shown in FIG. 6, which is a sectional side view of a modified window frame 121. In this embodiment, a cavity 76 provided in the window frame 121 receives a cartridge 81. The cavity 76 is of dimensions just large enough to admit the cartridge 81. In this embodiment, the escape ladder 36 is loaded into the recess 32 provided inside the cartridge 81. The escape ladder 36 can then be deployed through the opening 31 provided in the top part of the cartridge 81. The cartridge 81 is secured within the cavity 76 by a bolt 87. The bolt 87 can be removed to allow insertion or removal of the cartridge 81 to or from the cavity 76.

FIG. 6 also shows the addition of a spacer 88 to each end of each rung 43. The spacers 88 are of round cross-sectional shape, and project horizontally inwardly from rungs 43. The spacers 88 are preferably integral with the rungs 43. In the operational position of the ladder, the spacers 88 project horizontally toward and engage a wall, to keep the rungs 43 spaced from the wall.

The following is a description of the operation of the embodiment of FIGS. 1–4. In an emergency, a person on the second floor of the two-story structure 10 who is prevented from reaching the door 11 can escape from the structure 10 by going to the second story window 13 equipped with the escape ladder system 16. The person may find that both the window part 22 and the sill part 23 of the second story window 13 are in their closed positions. When both the window part 22 and the sill part 23 are in their closed positions, the bottom edge of the window part 22 is resting on the seal element 61 which is located on an upward facing surface of the sill part 23. Thus, when both the window part 22 and the sill part 23 are in their closed positions, a seal is formed between the two parts 22 and 23 by the seal element 61.

As described previously in association with FIG. 2, the sill part 23 cannot be placed in the open position until the window part 22 is first placed in the open position. As shown in association with FIG. 4, when the sill part 23 is in the closed position, the opening 31 is blocked, which prevents the removal of the escape ladder 36 from the recess 32. Therefore, in order to utilize the escape ladder 36, the person first moves the window part 22 to the open position and then moves the sill part 23 to the open position. As is shown in association with FIG. 2, once both the window part 22 and the sill part 23 are in their open positions, the opening 31 is exposed and the escape ladder 36 can be deployed.

In order to deploy the escape ladder 36, the escaping person will reach, with one or more hands, through the opening 31 into the recess 32 and grasp part of the escape ladder 36. A preferred place to grasp the escape ladder 36 is typically the bottom rung 43, or some part of the first or second elongate elements 41 and 42 near the second ends 57 of the elongate elements 41 and 42. The person will then pull the escape ladder 36 out through the opening 31 and deploy it toward the outside of the second story window 13. As the escape ladder 36 is being deployed, the retaining element 52 moves in a vertical manner toward the top of the recess 32. As the retaining element 52 moves toward the top of the recess 32, the retaining element 52 comes into engagement with the downwardly facing surface 53. Once the retaining element 52 and the downwardly facing surface 53 are engaged, the retaining element 52 has reached its maximum vertical position and is prevented from exiting the recess 32 through the opening 31. Once the retaining element 52 has reached the top of the recess 32 the escape ladder 36 has typically been fully deployed, as is shown in FIG. 3. The person can now exit the structure 10 through the second story window 13 by descending to ground level via the escape ladder system 16.

In the alternate embodiment of FIG. 5, as previously described, the sill part 71 is not pivotally supported. However, the window part 22 must still first be in the open position before the sill part 71 can be moved away from the position of FIG. 5. The seal element 61 still creates a seal between the sill part 71 and window part 22 as previously described. In this embodiment, since the sill part 71 is coupled to the second ends 57 of the first and second elongate elements 41 and 42, the person first deploys the sill part 71 toward the outside of the second story window 13. Deploying the sill part 71 causes the rest of the escape ladder 36 to begin deployment. The person may or may not have to manually assist with the deployment of the escape ladder 36. The sill part 71 may or may not be of sufficient weight to complete the deployment of the escape ladder 36 without further manual assistance. Once the escape ladder 36 is fully deployed, the unattached sill part 71 acts as the bottom rung.

In the alternate embodiment of FIG. 6, the escape ladder 36 is stored in the recess 32 provided within the cartridge 81. The cartridge 81 can be inserted or removed from the cavity 76. Once the cartridge 81 has been inserted into the cavity 76, the cartridge 81 is secured in the cavity 76 using the bolt 87. When the cartridge 81 is secured in the cavity 76 by the bolt 87, the cartridge 81 cannot be removed, thus, in order to remove the cartridge 81 the bolt 87 must be unfastened. The cartridge 81 could be removed and replaced with a replacement cartridge in order to replace a damaged escape ladder. Alternatively, the cartridge 81 could be removed to facilitate repair of the escape ladder 36 after the escape ladder 36 had been damaged.

When an emergency situation arises, the cartridge 81 should already be secured within the cavity 76, and remains secured there throughout the emergency. In response to the emergency, the escape ladder 36 is deployed in substantially the same manner as described for the embodiment of FIGS. 1–4, and a detailed explanation of deployment is therefore not repeated for the embodiment of FIG. 6.

After the escape ladder 36 of FIG. 6 is deployed, the spacers 88 coupled to the rungs 43 ensure that an appropriate amount of space is maintained between the rungs 43 and the vertical building surface. The spacers 88 allow for a more secure footing on the rungs 43 for the person.

The present invention provides a number of technical advantages. One such technical advantage is the ability to store the escape ladder in a location near that of the expected emergency exit point. A further advantage is that the escape ladder can be quickly deployed in the event of an emergency. Yet another advantage is that the escape system is relatively simple and inexpensive, and produces minimal interference with normal use of an associated window.

Although one embodiment has been illustrated and described in detail, it should be understood that various changes, substitutions and alterations can be made therein without departing from the scope of the present invention. For example, although one of the embodiments shows the use of spacers for the rungs, the spacers could be used with any of the described embodiments. Also, the cartridge is secured in place by a bolt, but could be secured by some other release mechanism. As another example, the elongate elements are made of rope, but could be chains or some other flexible material.

It should also be recognized that direct connections disclosed herein could be altered, such that two such disclosed components or elements would be coupled to one another through an intermediate device or devices without being directly connected, while still realizing the present invention. Other changes, substitutions, and alterations are also possible without departing from the spirit and scope of the present invention, as defined by the following claims.

What is claimed is:

1. An apparatus, comprising:

a window frame, said window frame including a lower portion which has thereon an upwardly facing surface and which has therein a cavity opening upwardly through a first opening which is provided through said upwardly facing surface, said window frame further including a sill part movable relative to said lower portion between a first position obstructing said first opening and a second position remote from said first opening;

a window part supported in said window frame for movement relative thereto between open and closed positions, said window part being movable independently of said sill part, and said window part being in sealing engagement with said sill part when said window part is in said closed position and said sill part is in said first position;

a cartridge which is removably received in said cavity, said cartridge having therein a recess that opens upwardly through a vertical second opening provided in said cartridge;

means for releasably securing said cartridge within said cavity;

an escape ladder which includes flexible first and second rope elements each having first and second ends, wherein said second end of each said rope element is coupled to an underside of said sill part, wherein said sill part initiates movement of said ladder out of said recess as said sill part moves away from said first position and wherein said sill part includes a downward projection of appropriate dimensions to approximately fill said second opening, said escape ladder further including a plurality of rung elements extending between said rope elements at spaced locations therealong, wherein each of said rung elements has an integrally formed spacer which projects outwardly at each end thereof, and wherein said ladder can be removably received within said recess; and a retaining element disposed within said recess and coupled to said first end of each said rope element, and wherein said retaining element has a size which is greater than a dimension of said second opening and prevents said retaining element from passing through said second opening.

2. An apparatus according to claim 1, wherein said ladder is withdrawn from said recess through said opening when said sill part is in said second position.

3. An apparatus according to claim 1, wherein said retaining element moves in a vertical direction within said recess.

4. An apparatus according to claim 1, wherein one of said window part and said sill part further includes means for effecting a seal between said sill part and said window part.

5. An apparatus according to claim 1, wherein said second opening through upwardly facing surface is of a size greater than the size of a human hand and has at least one dimension less than the size of said retaining element.

6. An apparatus according to claim 1, wherein said window part moves substantially vertically within said window frame between said open and closed positions.

7. An apparatus according to claim 1, wherein said sill part includes a bottom step of said escape ladder.

8. An apparatus according to claim 1, wherein said spacers are of a round cross-sectional shape.

* * * * *